US012433416B2

(12) United States Patent
Williams

(10) Patent No.: US 12,433,416 B2
(45) **Date of Patent: *Oct. 7, 2025**

(54) SUPPORT BRIDGE FOR MODULAR FURNITURE

(71) Applicant: Williams-Smith Limited, LLC, Jamestown, NC (US)

(72) Inventor: Matthew Williams, Jamestown, NC (US)

(73) Assignee: Williams-Smith Limited, LLC, Jamestown, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/444,855

(22) Filed: Feb. 19, 2024

(65) Prior Publication Data

US 2025/0040720 A1 Feb. 6, 2025

Related U.S. Application Data

(63) Continuation of application No. 18/230,219, filed on Aug. 4, 2023, now Pat. No. 11,903,487.

(51) Int. Cl.
*A47C 13/00* (2006.01)
*A47C 17/86* (2006.01)

(52) U.S. Cl.
CPC ..... *A47C 13/005* (2013.01); *A47C 17/86* (2013.01)

(58) Field of Classification Search
CPC ..... A47C 13/005; A47C 1/124; A47C 17/86
USPC ..... 108/158.13, 64; 297/245, 3, 440.1, 297/440.14, 243
See application file for complete search history.

(56) References Cited

U.S. PATENT DOCUMENTS 4,077,666 A 3/1978 Heumann
4,409,906 A 10/1983 Alneng
5,738,414 A 4/1998 Wieland et al.
(Continued)

FOREIGN PATENT DOCUMENTS

CN 207100994 U 3/2018
GB 146508 A 11/1920

OTHER PUBLICATIONS

Pages from RH.com website showing could sofa modular collection, https://rh.com/us/en/catalog/category/products.jsp?categoryId=cat18490019&pgterm=category%3Acat18490019, known at least as early as Aug. 3, 2023, last viewed Aug. 17, 2023, 1 pg.
(Continued)

*Primary Examiner* — Jose V Chen
(74) *Attorney, Agent, or Firm* — Womble Bond Dickinson (US) LLP

(57) ABSTRACT

A module for a modular furniture assembly includes a front frame rail, a rear frame rail, a first side rail, a support system, and a support bridge. The first side rail extends between the front frame rail and the rear frame rail. The first side rail defines a saddle that recesses below the front end portion and the rear end portion. The support system is disposed between the front frame rail, the rear frame rail, and the first side rail of the module. The support system is configured to support a user on the module. The support bridge is attached to the support system and is configured to attached to a support system of an adjacent module to functionally connect the support system of the module to the support system of the adjacent module such that forces are transferred therebetween.

21 Claims, 5 Drawing Sheets

(56) References Cited

U.S. PATENT DOCUMENTS

| | | | | |
|---|---|---|---|---|
| 6,783,182 | B1 | 8/2004 | Gallagher | |
| 6,796,614 | B1 | 9/2004 | Paul | |
| 6,827,407 | B2 | 12/2004 | Niederman et al. | |
| 7,448,689 | B2 | 11/2008 | Carter et al. | |
| 7,913,637 | B2 | 3/2011 | Roehm, II et al. | |
| 8,528,972 | B2 | 9/2013 | Johnsson | |
| 8,950,817 | B2 * | 2/2015 | Lacovoni | A47B 13/021 297/135 |
| 9,072,373 | B2 * | 7/2015 | Hixson | F16B 12/125 |
| 10,743,676 | B1 | 8/2020 | Galjour | |
| 11,903,487 | B1 | 2/2024 | Williams | |
| 2004/0095000 | A1 | 5/2004 | Durling | |
| 2007/0063118 | A1 | 3/2007 | Owens et al. | |
| 2007/0210631 | A1 | 9/2007 | Berning et al. | |
| 2009/0045666 | A1 | 2/2009 | Westendorf et al. | |
| 2010/0176634 | A1 | 7/2010 | Wahl et al. | |
| 2012/0146382 | A1 | 6/2012 | Griggs, Jr. | |
| 2013/0302085 | A1 | 11/2013 | King | |
| 2015/0289647 | A1 | 10/2015 | Lin | |
| 2021/0093087 | A1 | 4/2021 | Zei et al. | |
| 2022/0304472 | A1 | 9/2022 | Grathwol et al. | |
| 2023/0200545 | A1 | 6/2023 | McCreary et al. | |
| 2023/0235768 | A1 | 7/2023 | Wang | |

OTHER PUBLICATIONS

Pages from RH.com website showing cloud sofa, https://rh.com/us/en/cloud-sofa, known at least as early as Aug. 3, 2023, last viewed Aug. 17, 2023, 5 pgs.

Pages from RH.com website showing cloud sofa dimensions, http://images.restorationhardware.com/content/catalog/tearsheets/Upholstery_Cloud_Modular.pdf, known at least as early as Aug. 3, 2023, last viewed Aug. 17, 2023, 4 pgs.

Pages from RH.Gom website showing cloud sofa options, https://rh.com/us/en/catalog/product/product.jsp?productId=prod9740156&layout=horizontal, known at least as early as Aug. 3, 2023, last viewed Aug. 17, 2023, 1 pg.

International Search Report and Written Opinion for application No. PCT/IB2024/057480, dated Sep. 25, 2024, 7 pgs.

* cited by examiner

SUPPORT BRIDGE FOR MODULAR FURNITURE

CROSS-REFERENCE TO RELATED APPLICATION

This application claims benefit of, and priority to, U.S. patent application Ser. No. 18/230,219, filed Aug. 4, 2023, the entire contents of which are hereby incorporated by reference.

BACKGROUND

1. Technical Field

The present disclosure relates to modular furniture and, more specifically, to a support bridge for modular furniture.

2. Discussion of Related Art

Modular furniture is provided in pieces or modules that form a larger piece from the individual modules. Modular furniture can be preferred to a single piece of furniture as it is easier to move from one location to another and may be less expensive than a single piece of custom furniture. One form of modular furniture is a sectional sofa that may include one or more arms, armless chairs, corners, armless and backless chair, and/or chaise modules. The modules can be connected by a variety of means.

Generally, each module includes a full frame below a cushion. The frame can be felt between the modules if a person sits at or near the point of separation or gap between two modules. Typically, as each module is formed from a different frame, load is not transferred between the modules which can result in a non-uniform support of a person sitting across the gap.

SUMMARY

This disclosure relates generally to modular furniture that includes a support bridge assembly. The support bridge assembly includes a support bridge that extends between modules to transfer loads between the modules. The support bridge assembly includes a cutaway frame at the edge of the frame and adjacent another module. The cutaway frame may prevent a user from feeling a ridge between the two modules.

In an aspect of the present disclosure, a modular furniture assembly includes a first module, a second module, and a support bridge. The first module includes a front frame rail, a rear frame rail, a first side rail, and a first support system. The front frame rail has a front top surface and the rear frame rail has a rear top surface. The first side rail extends between the front frame rail and the rear frame rail and has a front end portion adjacent the front top surface and a rear end portion adjacent the rear top surface. The first side rail defines a saddle between the front end portion and the rear end portion that recesses below the front end portion and the rear end portion. The first support system is disposed between and may be supported by the front frame rail, the rear frame rail, the first side rail. The first support system is configured to support a user on the first module. The second module includes a front frame rail, a rear frame rail, a second side rail, and a second support system. The front frame rail has a front top surface and the rear frame rail has a rear top surface. The second side rail extends between the front frame rail and the rear frame rail and has a front end portion adjacent the front top surface and a rear end portion adjacent the rear top surface. The second side rail defines a saddle between the front end portion and the rear end portion that recesses below the front end portion and the rear end portion. The second support system is disposed between and may be supported by the front frame rail, the rear frame rail, the second side rail. The second support system is configured to support a user on the second module. The support bridge is attached to the first support system and the second support system and configured to functionally connect the first support system to the second support system such that forces are transferred therebetween.

In aspects, the support bridge is fixedly attached to the first support system. The support bridge may be releasably attached to the first support system. The support bridge may be releasably attached to the second support system.

In some aspects, the first support system includes a plurality of nosag springs that extend between the front frame rail and the rear frame rail of the first module. The second support system may include a plurality of nosag springs that extend between the front frame rail and the rear frame rail of the second module. The second support system may include a plurality of pocket springs or coil springs that are disposed between the front frame rail and the rear frame rail of the second module.

In certain aspects, the first module includes a first connector secured to a bottom of the first side rail and the second module includes a second connector secured to a bottom of the second side rail. The first connector and the second connector may be configured to connect the first module to the second module. In particular aspects, the support bridge may be the only connection between the first module and the second module.

In aspects, the modular furniture assembly includes a third module that has a third support system and a second support bridge. The third module may be adjacent the first module. The second support bridge may functionally connect the first support system with the third support system. The second support bridge may extend over the front frame rail of the first module or may extend over a side rail of the first module that is opposite the first side rail of the first module.

In another aspect of the present disclosure, a module for a modular furniture assembly includes a front frame rail, a rear frame rail, a first side rail, a support system, and a support bridge. The front frame rail has a front top surface and the rear frame rail has a rear top surface. The first side rail extends between the front frame rail and the rear frame rail. The first side rail has a front end portion adjacent the front top surface of the front frame rail and a rear end portion that is adjacent the rear top surface of the rear frame rail. The first side rail defines a saddle between the front end portion and the rear end portion that recesses below the front end portion and the rear end portion. The support system is disposed between the front frame rail, the rear frame rail, and the first side rail of the module. The support system is configured to support a user on the module. The support bridge is attached to the support system and is configured to attached to a support system of an adjacent module to functionally connect the support system of the module to the support system of the adjacent module such that forces are transferred therebetween.

In aspects, the support bridge is releasably attached to the support system. The support system may include a main support and a deck supported on and concealing the main support. The support bridge may be attached to a top surface of the deck. The main support may include a plurality of nosag springs that extend between the front frame rail and the rear frame rail. The main support may include a plurality of pocket springs or coil springs that are disposed between the front frame rail and the rear frame rail.

In some aspects, the support system includes a plurality of transfer supports that extend parallel to the front frame rail and the rear frame rail. The support bridge may be configured to transfer forces from the plurality of transfer supports to the support system of the adjacent module.

In certain aspects, the module includes a second side rail that is opposite the first side rail. The second side rail may extend between the front frame rail and the rear frame rail. The second side rail may have a front end portion that is adjacent the first top surface of the front frame rail and a rear end portion that is adjacent the rear top surface of the rear frame rail. The second side rail may define a saddle between the front end portion and the rear end portion that recesses below the front end portion and the rear end portion.

In particular aspects, the module is a corner, a right-armchair, a left-armchair, an armless chair, a right-arm sofa, a left-arm sofa, an armless sofa, an armless and backless chair, or a chaise. The module may be a corner such that the front frame rail is configured to be positioned adjacent another module connected to the module. The front frame rail may define another saddle.

In another aspect of the present disclosure, a modular furniture assembly includes a first module, a second module, and a support bridge. The first module has a first side rail and a first support system that is configured to support a user on the first module. The second module has a second side rail and a second support system that is configured to support a user on the second module. The second module is posed adjacent the first module such that the second side rail is adjacent and in opposition to the first side rail with a gap defined therebetween. The support bridge is attached to the first support system and the second support system and configured to functionally connect the first support system to the second support system such that forces are transferred therebetween. The first module and the second module configured to prevent a user from feeling a discontinuity at the gap. The first side rail and the second side rail may each define a saddle recess in a top surface thereof.

Further, to the extent consistent, any of the embodiments or aspects described herein may be used in conjunction with any or all of the other embodiments or aspects described herein.

BRIEF DESCRIPTION OF THE DRAWINGS

Various aspects of the present disclosure are described hereinbelow with reference to the drawings, which are not necessarily drawn to scale, which are incorporated in and constitute a part of this specification, wherein.

DETAILED DESCRIPTION

Figure 1:
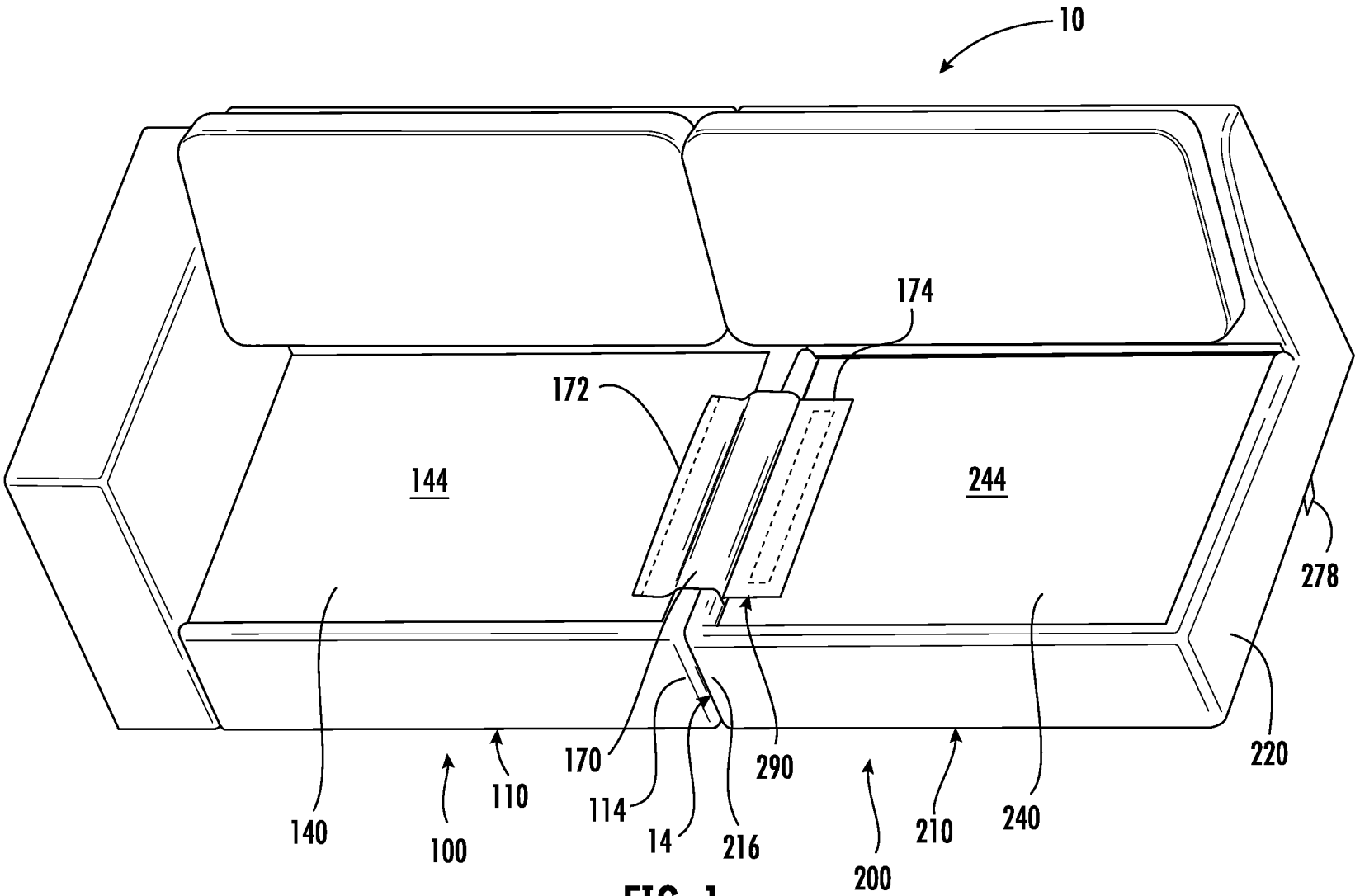
FIG. 1 is a perspective view of a modular furniture assembly provided in accordance with embodiments of the present disclosure.

The present disclosure will now be described more fully hereinafter with reference to example embodiments thereof with reference to the drawings in which like reference numerals designate identical or corresponding elements in each of the several views. These example embodiments are described so that this disclosure will be thorough and complete, and will fully convey the scope of the disclosure to those skilled in the art. Features from one embodiment or aspect can be combined with features from any other embodiment or aspect in any appropriate combination. For example, any individual or collective features of method aspects or embodiments can be applied to apparatus, product, or component aspects or embodiments and vice versa. The disclosure may be embodied in many different forms and should not be construed as limited to the embodiments set forth herein; rather, these embodiments are provided so that this disclosure will satisfy applicable legal requirements. As used in the specification and the appended claims, the singular forms "a," "an," "the," and the like include plural referents unless the context clearly dictates otherwise. In addition, while reference may be made herein to quantitative measures, values, geometric relationships or the like, unless otherwise stated, any one or more if not all of these may be absolute or approximate to account for acceptable variations that may occur, such as those due to manufacturing or engineering tolerances or the like.

Referring now to FIG. 1, a modular furniture assembly 10 is provided in accordance with the present disclosure. As shown, modular furniture assembly 10 includes a first module 100 and a second module 200. As shown, the first module 100 is a right-armchair and the second module 200 is an armless chair. In embodiments, the first module 100 or the second module 200 may be a right-armchair, a left-armchair, a right-arm sofa, a left-arm sofa, an armless chair, a corner, a wedge, an armless and backless chair, or a chaise. As shown, the modular furniture assembly 10 is shown as a stationary furniture assembly 10. In some embodiments, one or more of the modules of the modular furniture assembly 10 may be a motion module in which the module includes a motion back and/or a motion apron.

The modular furniture assembly 10 includes a support bridge 170 that extends from the first module 100 to the second module 200. As shown, the support bridge 170 is fixed to the first module 100 and is secured to the second module by a fastener system 290. In some embodiments, the support bridge 170 may be secured to the first module 100 by a fastener system similar to the fastener system 290. As described in greater detail below, the support bridge 170 transfer loads between a support system 130 (FIG. 3) of the first module 100 and a support system 230 (FIG. 4) of the second module 200. The support bridge 170 extends over a gap 14 (FIG. 1) that is defined between the first module 100 and the second module 200.

Figure 2:
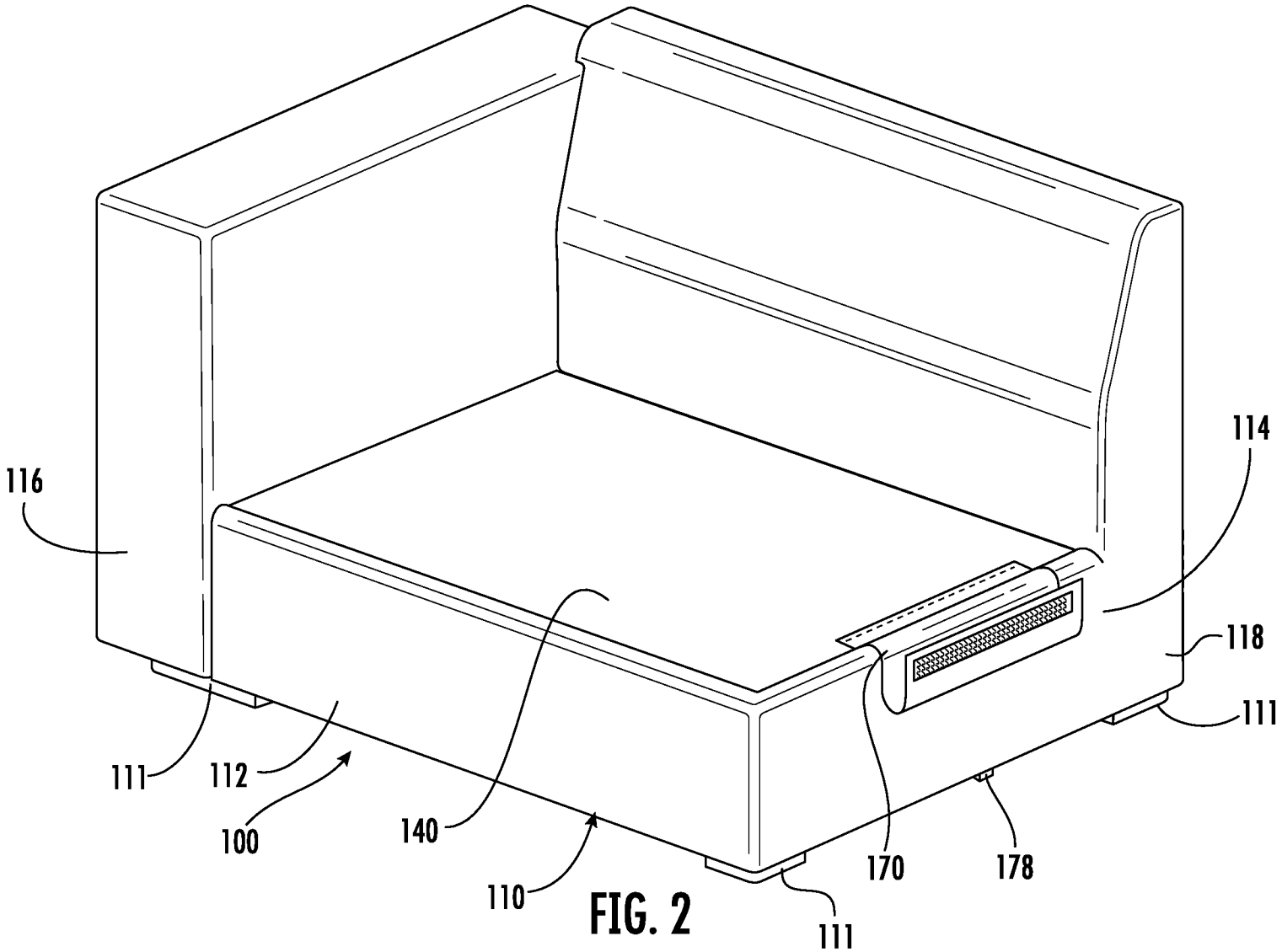
FIG. 2 is a perspective view of a first module of the modular furniture of FIG. 1.
Figure 3:
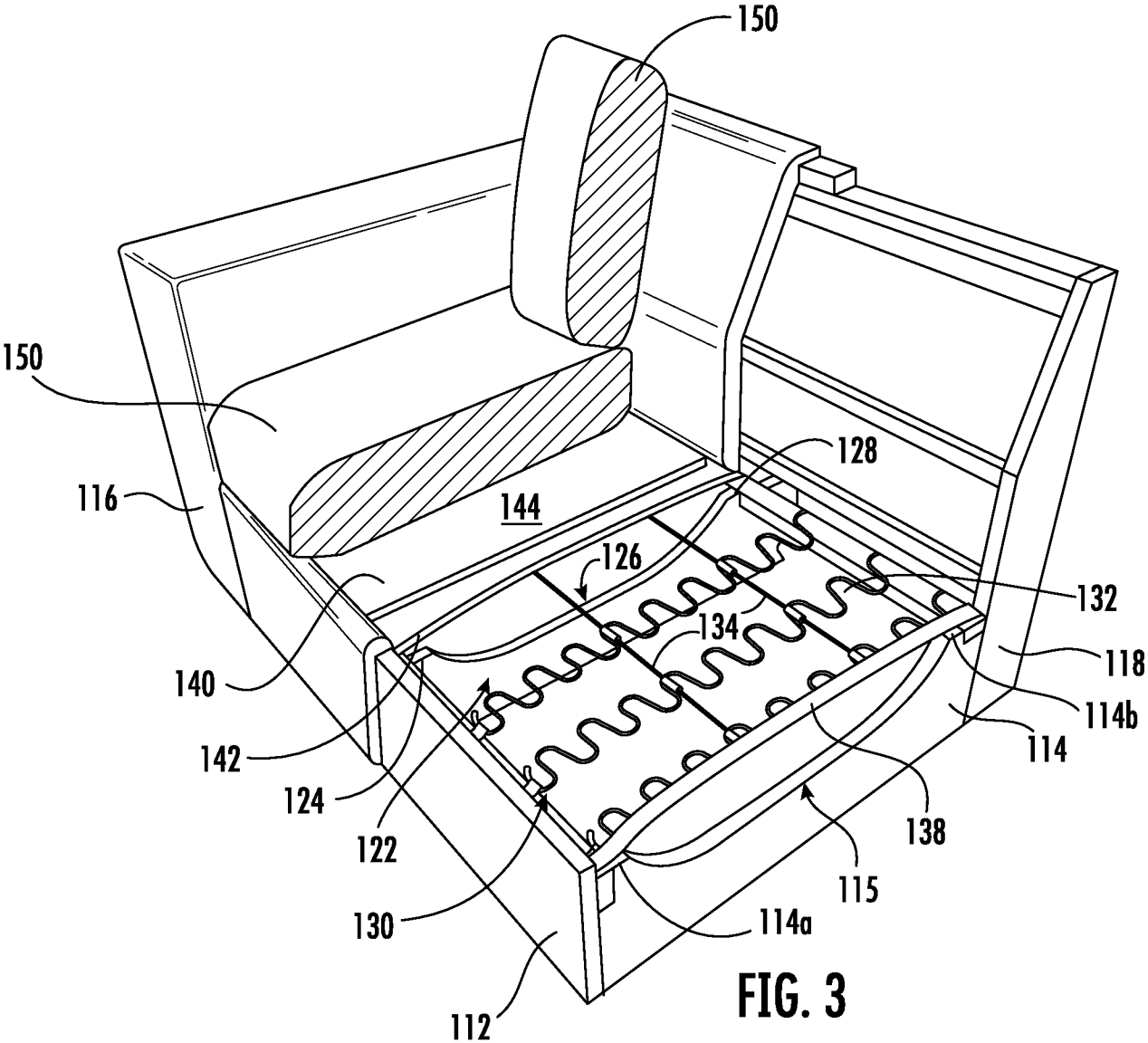
FIG. 3 is a perspective cutaway view of the first module of FIG. 2.

Referring now to FIGS. 2 and 3, the first module 100 is shown separate from another module, e.g., the second module 200. The first module 100 includes a frame 110, a support system 130, cushions 150, and the support bridge 170. The frame 110 includes a front frame rail 112, a rear frame rail 118, a first side rail 114, and a second side rail 116. The front frame rail 112 may define a front of the first module 100 and the rear frame rail 118 may define a back of the first module 100. In some embodiments, the front frame rail 112 and/or the rear frame rail 118 may be linear, may include a number of linear elements that are joined together, or may be arcuate. For example, the front or the rear of the module may be curved to form a curved corner or curved seat section. In some embodiments, the front frame rail 112 and/or the rear frame rail 118 may include a number of linear elements to form a wedge shape. In certain embodiments, the front frame rail 112 and/or the rear frame rail 118 may have an irregular shape and may be non-symmetrical with one another.

The first side rail 114 is disposed on a side of the first module 100 that is configured to connect to another module, e.g., the second module 200. The first side rail 114 extends between the front frame rail 112 and the rear frame rail 118. The second side rail 116 is on an opposite side of the first module 100 from the first side rail 114 and extends between the front frame rail 112 and the rear frame rail 118. In some embodiments, the second side rail 116 is disposed on a side of the first module 100 that is configured to connect to another module. In such embodiments, the second side rail 116 may be similar to the first side rail 114. In certain embodiments, the second side rail 116 is a free-standing end of the module 100 and may include an arm or other structure to form an end of the modular furniture assembly 10. The second side rail 116 may be parallel to the first side rail 114. In some embodiments, the second side rail 116 may be perpendicular to the first side rail 114, e.g., when the module 100 is a corner module. In particular embodiments, the first module 100 may be a corner unit and not include a front frame rail. In such embodiments, the first side rail 114 may extend between the second side rail 116 and a rear frame rail 118 and the second side rail 116 may extend between the first side rail 114 and the rear frame rail 118.

The frame rails 112, 114, 116, 118 are configured to support the structure of the module 100. One or more of the frame rails 112, 114, 116, 118 may be configured to rest directly on a floor or may be supported on the floor by feet 111. In some embodiments, one or more of the frame rails 112, 114, 116, 118 can be supported spaced apart from the floor at or adjacent an elevated seat height. For example, one or more of the frame rails 112, 114, 116, 118 may be supported on the floor by legs or posts that touch the floor and supports the respective frame rail 112, 114, 116, 118 at or adjacent the elevated seat height.

In some embodiments, the first module 100 may include a middle support 122 that extends between the front frame rail 112 and the rear frame rail 118. For example, when the first module 100 is a multiple seat module, e.g., a two-seat or a three-seat module, the first module 100 may include a middle support 122 disposed between adjacent seats of the module. In some embodiments, the middle support 122 is disposed at predetermined distances from the first side rail 114 and/or the second side rail 116. The predetermined distance may be in a range of 12 inches to 36 inches, e.g., 24, 26, 28, 30, 32, 34, or 36 inches. The middle support 122 may be parallel to one or both of the first side rail 114 and the second side rail 116. The middle support 122 may be configured to rest directly on a floor or may be supported on the floor by a foot 111. In some embodiments, the middle support 122 may be spaced apart from the floor without being supported on the floor. The middle support 122 includes a front top portion 124 that is adjacent the front frame rail 112 and a rear top portion 128 adjacent the rear frame rail 118. In some embodiments, the front top portion 124 may have a height that is equal to, greater than, or less than a height of the rear top portion 128. The middle support 122 includes a saddle 126 defined in the top surface between the front top portion 124 and the rear top portion 128 such that the front top portion 124 and the rear top portion 128 are adjacent and may be congruent with a top end of the front frame rail 112 and the rear frame rail 118, respectively. The saddle 126 may be a substantially U-shaped recess or cutout defined in a top edge of the middle support 122 such that the top edge of the middle support 122 is spaced apart from the support system 130. Spacing apart the saddle 126 from the support system 130 may increase comfort of a user sitting over the middle support 122. Spacing apart the saddle 126 from the support system 130 may prevent a user from feeling a ridge or a discontinuity between seats of the module 100.

The first side rail 114 includes a saddle 115 that is similar to the saddle 126 of the middle support 122 such that the first side rail 114 includes a front top portion 114*a* and a rear top portion 114*b* that are adjacent a top end of the front frame rail 112 and the top end of the rear frame rail 118, respectively. The saddle 115 of the first side rail 114 is recessed away from the support system 130 which may increase comfort of a user sitting over the first side rail 114. Recessing the saddle 115 from the support system 130 may cause a user sitting over the first side rail 114 to not feel the first side rail 114. In contrast, a traditional side rail of a module includes a flat top surface that engages or is close to the support system such that when a user sits over the side rail between two modules, the user feels a ridge between the two modules. As such, saddle 115 in the first side rail 114 removes the ridge between two modules that may be felt by a user in a traditional modular furniture assembly. In some embodiments, the first side rail 114 and/or the middle support 122 includes a flat top surface that extends between the front frame rail 112 and the rear frame rail 118 to maintain a distance between the front frame rail 112 and the rear frame rail 118. The flat top surface of the first side rail 114 and/or the middle support 122 may be considered the saddle 115, 126 that is spaced apart from the deck 140. The top surface of the first side rail 114 and/or the middle support 122 may prevent a user from "bottoming out" on the respective rail at the lowest point of the support system.

Continuing to refer to FIG. 3, the support system 130 includes a main support 132, a transfer support 134, an edge support 138, and a deck 140. The main support 132 is configured to support the weight of a user between the front frame rail 112 and the rear frame rail 118. As shown, the main support 132 is in the form of a series or plurality of nosag or sinuous springs that extend between the front frame rail 112 and the rear frame rail 118. In some embodiments, the main support 132 is a plurality of coil springs, a plurality of pocket springs, poly-cellular foam block, elastic straps such as Pirelli webbing, or a hybrid main support which is a combination of one or more of types of main supports.

The edge support 138 extends between the front frame rail 112 and the rear frame rail 118 and is positioned over the first side rail 114. The edge support 138 may cover a portion of the main support 132 to protect an edge of the main support 132. The edge support 138 provides support over the first side rail 114 such that the edge support 138 provides support similar or equal to the rest of the main support 132. The edge support 138 may be a portion of the main support 132. In embodiments, the edge support 138 forms the outside top edge of the deck 140 such that the edge support 138 may be used to align adjacent modules of the modular furniture assembly. For example, the edge support may be used to align the modules such that the seat cushions of adjacent modules are even between the front frame rails and the rear frame rails and level across the main supports of the adjacent modules.

The transfer supports 134 extend between the first side rail 114 and the second side rail 116 to transfer loads or forces between the main supports 132. The transfer supports 134 may align the main supports 132 with one another to distribute loads or forces across the main supports 132. The transfer supports 134 may vary depending on the type of main support 132. For example, as shown, when the main support 132 is formed of sinuous springs, the transfer supports 134 may be tie wires that extend in a direction substantially perpendicular to the sinuous springs and are connected to each of the sinuous springs where crossed. In other examples, coil springs may be tied together (eight-directions) as a transfer support, pocketed coil springs may be sewn or glued to a fabric sheet that extends over the top and bottom surfaces thereof as a transfer support, webbing may be woven together by transfer supports, and cellular foam may include a cover as a transfer support.

The deck 140 is disposed over the main supports 132, the transfer supports 134, and the edge support 138 to conceal the supports 132, 134, 138. The deck 140 may include a foam layer 142 facing the supports 132, 134, 138. The deck 140 may distribute loads or forces such that the support system 130 provides a uniform feel to a user sitting on the module 100.

As detailed below, the support systems of the adjacent modules, e.g., support system 130, 230, are configured to support a user on the frame of each module, e.g., frame 110, 210, but are not configured to support a user that is sitting over a gap 14 between adjacent modules. As such, a user sitting over the gap 14 between adjacent modules may feel a discontinuity in support between adjacent modules. Further, traditional modular furniture assemblies include full side rails between adjacent modules such that a user may feel a ridge or hard point at the gap as the side rails provide support to the user. As detailed above, the modules of the modular furniture assembly 10 have a saddle defined in the side rails that define the gap 14 between modules, e.g., first side rail 114 of the first module 100 and the second side rail 216 of the second module 200. However, removing the top portion of the side rails to form the saddles relies on the support systems of the adjacent modules to support the user over the respective side rail. As such, a user sitting over the adjacent side rails may feel a discontinuity in support or may sink into the gap 14 between the modules. In some embodiments, the first and second side rail 114, 216 do not include saddles but have a height less than the front frame rails or the rear frame rails such that the first and second side rails 114, 216 are positioned below out of engagement with the support systems of the respective modules.

Referring back to FIGS. 1 and 2, the support bridge 170 is described in accordance with embodiments of the present disclosure. The support bridge 170 extends between the first module 100 and the second module 200 to distribute loads or forces between the support system 130 of the first module 100 and the support system 230 of the second module 200. Distributing loads between the support system 130 and the support system 230 may reduce or eliminate discontinuities in support between adjacent modules, e.g., modules 100, 200. The support bridge 170 may act as a ligature between the two adjacent modules to prevent a user from sinking into a gap between the two modules. In some embodiments, the saddles of the adjacent side rails and the support bridge may erase the feel of a ridge between adjacent modules of a modular furniture assembly.

The support bridge 170 is secured to a top surface 144 of the deck 140 of the first module 100 and is secured to a top surface 244 of the deck 240 of the second module 200 which is adjacent the first module 100. The support bridge 170 functionally connects the deck 140 of the first module 100 with the deck 240 of the second module 200 to transfer loads or forces between the support system 130 of the first module 100 and the support system 230 of the second module 200. Functionally connecting the decks 140, 240 may also functionally connect the transfer supports 134 of the first module 100 to the transfer supports 234 of the second module 200 to transfer loads or forces therebetween. In some embodiments, a first portion 172 of the support bridge 170 is fixedly secured to the top surface of the deck 140. For example, the first portion 172 of the support bridge 170 may be stitched to the top surface of the deck 140. In certain embodiments, the first portion 172 is releasably secured to the top surface of the deck 140. For example, the first portion 172 may include a first part of a two-part fastening system and the top surface of the deck 140 may include a second part of the two-part fastening system to releasably secure the first portion 172 to the deck 140. The support bridge 170 includes a second portion 174 that is releasably secured to the top surface of the deck 240. For example, the second portion 174 may include a first part of a two-part fastening system and the top surface of the deck 240 may include a second part of the two-part fastening system to releasably secure the second portion 174 to the deck 240. In particular embodiments, the support bridge 170 may act as a ligature between the first module 100 and the second module 200 to support a user sitting over the gap 14 between adjacent modules, e.g., modules 100, 200.

The support bridge 170 connects the first module 100 to the second module 200. In some embodiments, the support bridge 170 may be the only connection between adjacent modules, e.g., modules 100, 200. In certain embodiments, the first module 100 may include a male alligator clip or connector 178 (FIG. 2) attached to the bottom of the first side rail 114 and the second module 200 may include a female alligator clip or connector (not shown) attached to the bottom of a second side rail 216 that is adjacent the first side rail 114 such that the female connector receives the male connector 178 to connect the first module 100 to the second module 200. In such embodiments, the support bridge 170 may supplement the connection between the male connector 178 and the female connector.

Figure 4:
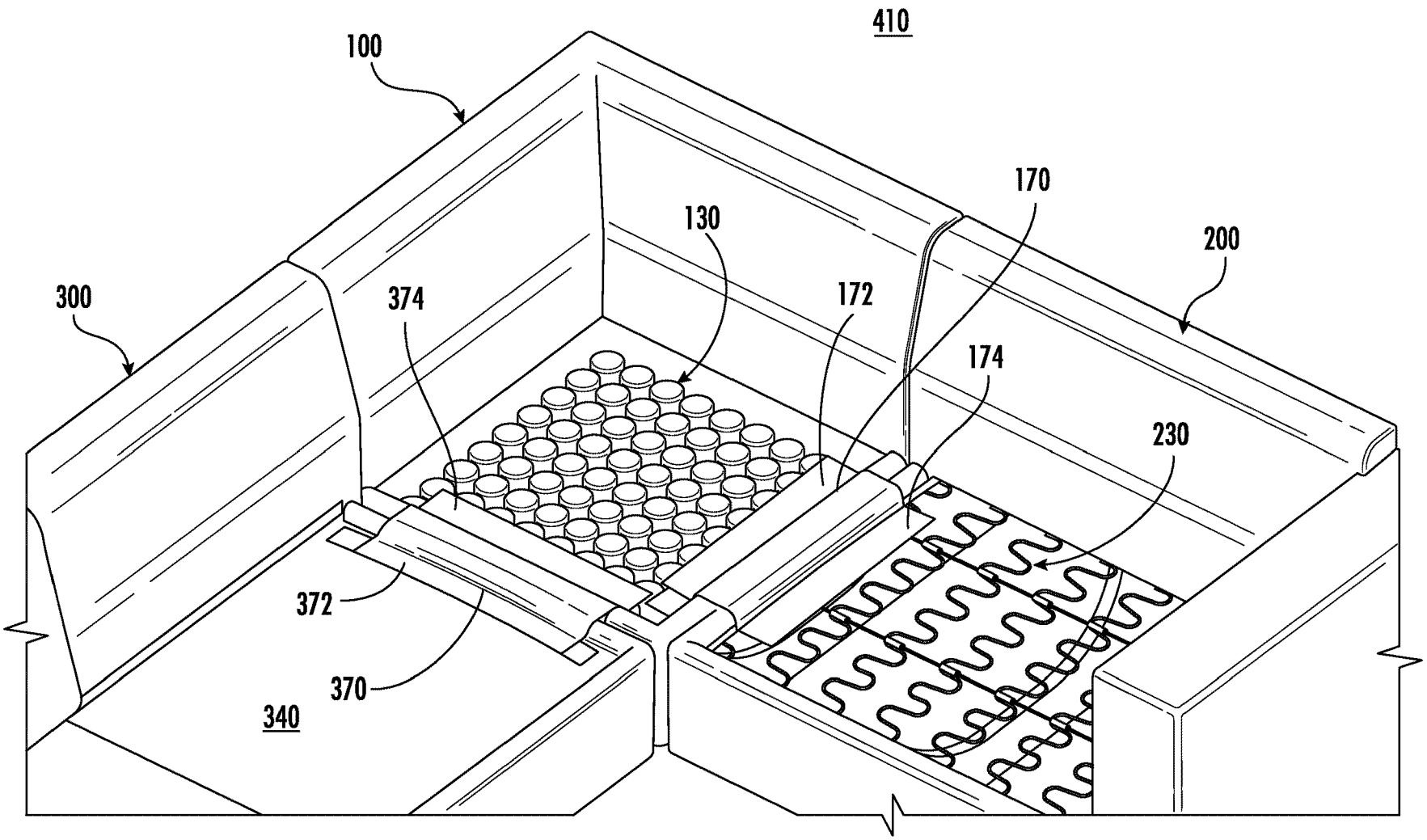
FIG. 4 is a perspective view of another modular furniture assembly provided in accordance with the present disclosure with the support decks removed from the first and second modules thereof.

With reference to FIG. 4, another modular furniture assembly 410 is provided in accordance with the present disclosure. The modular furniture assembly 410 includes a first module 100, a second module 200, and a third module 300. The elements of the modules 100, 200, 300 may be similar to one another and the elements of the first module 100 detailed above and include similar labels with only the leading digit different between modules for identification. For reason of brevity, only the differences between the assembly 410 and the assembly 10 will be detailed herein.

The first module 100 is disposed between the second module 200 and the third module 300. The first module 100 includes a support system 130 with a main support formed of pocket springs. The first module 100 includes support bridge 170 that functionally connects the support system 130 of the first module 100 to the support system 230 of the second module 200. The support system 230 of the second module 200 has a main support of nosag springs which are functionally connected to the pocket springs of the first module 100. The support bridge 170 may prevent a user from detecting a discontinuity in the support system 130 of the first module 100 and the support system 230 of the second module 200. It will be appreciated that the support decks of the first module 100 and the second module are removed to allow the support systems 130, 230 to be visible.

The third module 300 includes a support bridge 370 that connects the support system 330 (not explicitly shown) of the third module 300 to the support system 130 of the first module 100. The support bridge 370 may be permanently fixed, e.g., stitched, to the support deck 340 of the third module 300 and releasably secured, e.g., via a two-part fastener system, to the first module 100. The support system 330 of the third module 300 may be pocket springs, coil springs, or nosag springs.

The support bridges 170, 370 of the assembly 410 may functionally connect the support systems of the first, second, and third modules 100, 200, 300 such that the support at any point of the assembly 410 is the same as all other points of assembly 410. Having the same support at all points or similar points of the assembly 410 may allow the assembly 410 to feel like a single unit instead of a modular assembly 410.

Figure 5:
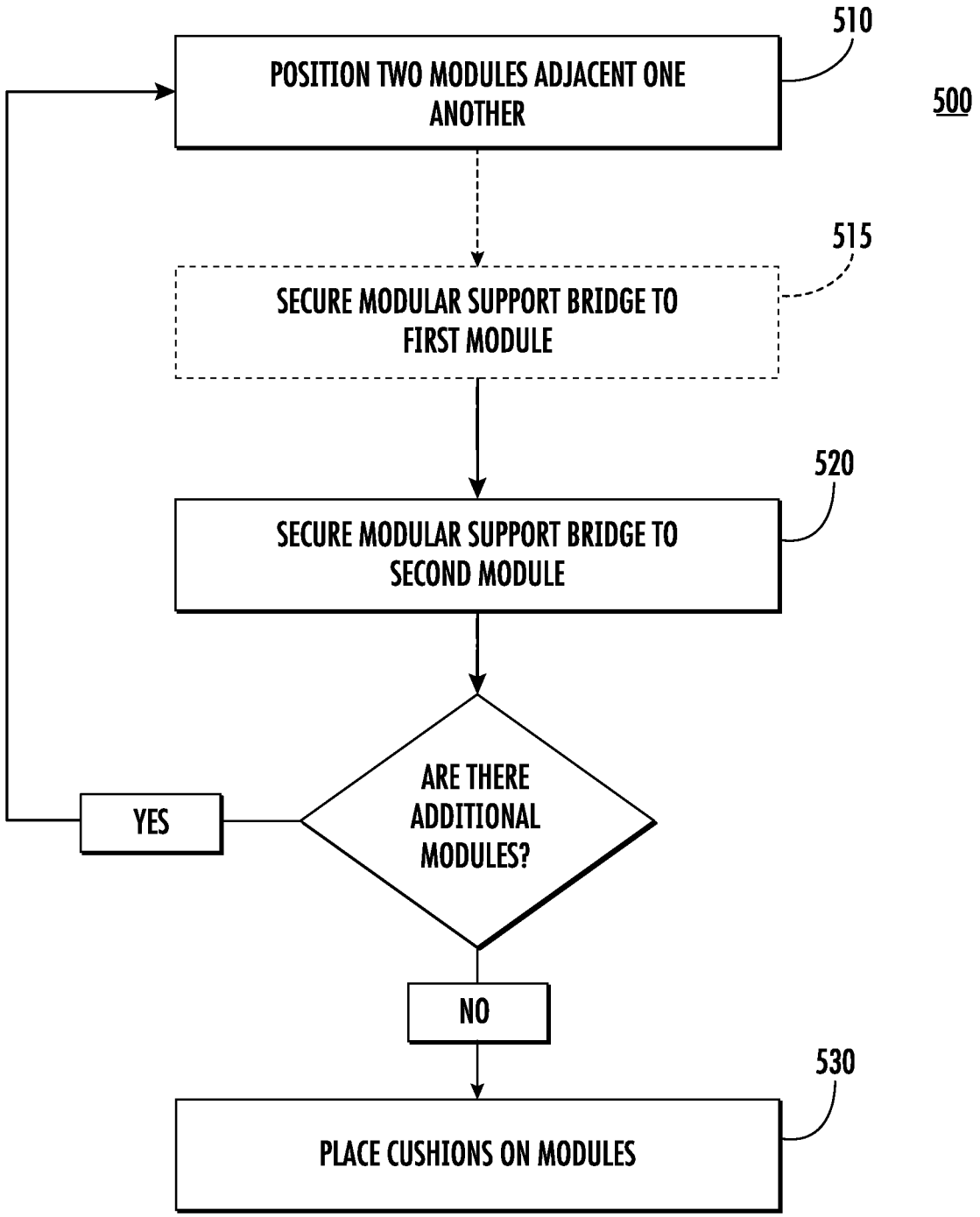
FIG. 5 is a flowchart of a method of assembling a modular furniture assembly.

Referring now to FIG. 5, a method 500 for assembling a modular furniture assembly is described in accordance with embodiments of the present disclosure. The method 500 is described in relation to assemblies 10 and 410 of FIGS. 1-4. The method 500 includes positioning a first module 100 adjacent a second module 200 such that a gap 14 is defined between the first and second modules 100, 200 (Step 510). Positioning the first module 100 adjacent the second module 200 may include receiving a connector 178 of the first module in a receiver or connector of the second module 200 to connect the first module 100 to the second module 200. The connector 178 may be a male clip that extends from a bottom of the first side rail 114 of the first module 100 and be received by a receiver or connector that is attached to the bottom of the second side rail 216 of the second module 200. In some embodiments, the connectors of the adjacent modules 100, 200 align the modules 100, 200 with respect to one another. In some embodiments, the modules 100, 200 do not include any such connectors.

With the first module 100 positioned adjacent the second module 200, a modular support bridge 170 of the first module 100 is secured to the top surface 244 of the support deck 240 of the second module 200 (Step 520). The support bridge 170 may be secured to the top surface 244 by two parts of a two-part fastener system engaging one another to releasably secure the support bridge 170 to the top surface 244. In some embodiments, the support bridge 170 must be releasably secured to the first module 100 before or after being releasably secured to the second module 200 (Step 515). In such embodiments, the support bridge 170 may be secured to the top surface 144 of the first module 100 by engaging two parts of a two-part fastener system with one another. In certain embodiments, the support bridge 170 is fixedly secured to the top surface 144 of the first module 100.

Once the first module 100 and the second module 200 are secured to one another with the support bridge 170, additional modules, e.g., module 300, may be secured to the first module 100 or the second module 200 and so on with additional support bridges, e.g., support bridge 370, until all the modules are secured to one another. Once all the modules are secured to one another, cushions, e.g., cushions 150, may be placed on the support decks, e.g., support deck 140, 240, to conceal the support decks and the support bridges such that the modular furniture assembly functions as a continuous unit (Step 530). The cushions may provide additional support or comfort to a user sitting on the modular assembly. As shown, the cushions 150 which include back cushions and seat cushions are shown as loose cushions; however, the seat cushions and/or back cushions may be loose cushions, semi loose cushions, faux loose cushions, tight back, or tight seat cushions.

Although the method steps are described in a specific order, it should be understood that other steps may be performed in between described steps, described steps may be adjusted so that they occur at slightly different times, or the described steps may occur in any order unless otherwise specified.

While several embodiments of the disclosure have been shown in the drawings, it is not intended that the disclosure be limited thereto, as it is intended that the disclosure be as broad in scope as the art will allow and that the specification be read likewise. Any combination of the above embodiments is also envisioned and is within the scope of the appended claims. Therefore, the above description should not be construed as limiting, but merely as exemplifications of particular embodiments. Those skilled in the art will envision other modifications within the scope of the claims appended hereto.

What is claimed:

1. A method of manufacturing a furniture module, the method comprising:

assembling a frame having a front frame rail, a rear frame rail, and a first side rail extending between the front frame rail and the rear frame rail;

securing a support system to the front frame rail and the rear frame rail such that the support system is configured to support a user, the support system spaced apart from a saddle defined in a first side rail such that a portion of the support system is capable of being disposed below and between a front end portion and a rear end portion of the first side rail; and attaching a support bridge to a top surface of the support system adjacent the first side rail, the support bridge configured to functionally connect the support system to a support system of an adjacent module such that forces are transferred therebetween.

2. The method according to claim 1, wherein attaching the support bridge to the top surface includes the support bridge being configured to extend over the saddle of the first side rail.

3. The method according to claim 1, wherein attaching the support bridge to the top surface includes releaseably securing the support bridge to the top surface of the support system.

4. The method according to claim 1, wherein securing the support system to the front frame rail and the rear frame rail includes concealing a main support of the support system with a deck of the support system that is secured to the front frame rail and the rear frame rail and includes the top surface of the support system.

5. The method according to claim 4, further comprising securing a plurality of nosag springs between the front frame rail and the rear frame rail to form the main support.

6. The method according to claim 5, further comprising installing a plurality of transfer supports to the main support with each of transfer support extending parallel to the front frame rail and the rear frame rail such that the plurality of transfer supports are configured to transfer forces to the support system of the adjacent module via the support bridge.

7. The method according to claim 1, wherein assembling the frame includes a second side rail extending between the front frame rail and the rear frame rail.

8. The method according to claim 7, wherein assembly the frame includes the second side rail being parallel to the first side rail.

9. The method according to claim 7, wherein securing the support system to the front frame rail and the rear frame sail includes the support system being spaced apart from a saddle defined in the second side rail such that a portion of the support system is capable of being disposed below and between a front end portion and a rear end portion of the second side rail.

10. The method according to claim 9, further comprising attaching a part of a two-part fastening system to the top surface of the support system adjacent the second side rail, the part of the two-part fastening system configured to secure to another part of the two-part fastening system of a support bridge of another adjacent module to transfer forces therebetween.

11. A method of manufacturing a modular furniture assembly, the method comprising:

assembling a first frame having a first front frame rail, a first rear frame rail, and a first side rail extending between the first front frame rail and the first rear frame rail;

securing a first support system to the first front frame rail and the first rear frame rail such that the first support system is configured to support a user on the first frame;

assembling a second frame having a second front frame rail, a second rear frame rail, and a second side rail extending between the second front frame rail and the second rear frame rail;

securing a second support system to the second front frame rail and the second rear frame rail such that the second support system is configured to support a user on the second frame;

attaching a support bridge to a top surface of the first support system adjacent the first side rail; and securing the support bridge to a top surface of the second support system adjacent the second side rail such that the support bridge transfers forces between the first support system and the second support system to form a continuous support system comprising the first support system and the second support system, the continuous support system providing support at any point that is the same as all other similar points of the continuous support system.

12. The method according to claim 11, wherein securing the first support system includes the first support system being spaced apart from a first saddle defined in the first side rail and securing the second support system includes the second support system being spaced apart from a second saddle defined in the second support rail.

13. The method according to claim 11, wherein securing the first support system includes the first support system being out of engagement with the first side rail.

14. A method of assembling modular furniture, the method comprising:

positioning a first module adjacent a second module such that a first side rail of a first frame of the first module is adjacent a second side rail of a second frame of the second module such that a gap is defined therebetween; and securing a support bridge of the first module to the second module such that the support bridge passes over the gap and a first support system of the first module is functionally connected to a second support system of the second module to form a continuous support system between the first module and the second module such that the support bridge distributes loads between the first support system and the second support system.

15. The method according to claim 14, wherein securing the support bridge prevents a user from feeling a discontinuity at a gap defined between the first module and the second module.

16. The method according to claim 14, wherein securing the support bridge to the second module includes securing a first part of a two-part fastening system that is attached to the support bridge to a second part of the two-part fastening system that is attached to a top surface of the second support system.

17. The method according to claim 16, further comprising securing the support bridge to the first module.

18. The method according to claim 14, wherein the positioning the first side rail adjacent the second side rail includes the first side rail and the second side rail each defining a saddle recess in a top surface thereof, the saddle recess spaced apart from the first support system and second support system.

19. The method according to claim 14, wherein securing the support bridge of the first module to the second module includes the first support system being out of engagement with the first side rail.

20. The method according to claim 14, wherein securing the support bridge prevents a user from feeling a discontinuity at a gap defined between the first module and the second module.

21. A method of assembling modular furniture, the method comprising:

positioning a first module adjacent a second module such that a first side rail of a first frame of the first module is adjacent a second side rail of a second frame of the second module; and securing a support bridge of the first module to the second module such that a first support system of the first module is functionally connected to a second support system of the second module to form a continuous support system between the first module and the second module such that the support bridge distributes loads between the first support system and the second support system, securing the support bridge to the second module includes securing a first part of a two-part fastening system that is attached to the support bridge to a second part of the two-part fastening system that is attached to a top surface of the second support system.

* * * * *